US010643574B2

(12) United States Patent
Tzeng et al.

(10) Patent No.: US 10,643,574 B2
(45) Date of Patent: May 5, 2020

(54) TIMING CONTROLLER AND OPERATION METHOD THEREOF

(71) Applicant: Novatek Microelectronics Corp., Hsinchu (TW)

(72) Inventors: Syang-Yun Tzeng, Taoyuan (TW); Cheng-Kai Kuei, Hsinchu (TW); Chin-Hung Hsu, Taoyuan (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/245,232

(22) Filed: Jan. 10, 2019

(65) Prior Publication Data

US 2019/0237041 A1 Aug. 1, 2019

Related U.S. Application Data

(60) Provisional application No. 62/624,073, filed on Jan. 30, 2018.

(51) Int. Cl.
*G09G 5/00* (2006.01)

(52) U.S. Cl.
CPC ..... *G09G 5/008* (2013.01); *G09G 5/005* (2013.01); *G09G 2330/06* (2013.01); *G09G 2370/08* (2013.01); *G09G 2370/14* (2013.01)

(58) Field of Classification Search
CPC ..... G09G 2370/14; G09G 2330/06; G09G 2370/08; G09G 5/005
See application file for complete search history.

(56) References Cited

U.S. PATENT DOCUMENTS

2007/0069214 A1* 3/2007 Lee ..... G09G 3/3648 257/72

* cited by examiner

*Primary Examiner* — Abbas I Abdulselam
(74) *Attorney, Agent, or Firm* — JCIPRNET

(57) ABSTRACT

A timing controller and an operation method thereof are provided. The timing controller includes a transmitter circuit and a control circuit. The control circuit ends a normal mode to enter a swing boost mode when a lock signal fed back by a source driving circuit indicates that quality of data signal is deteriorated in the normal mode. In the swing boost mode, the control circuit controls the transmitter circuit to boost the swing of the data signal from a normal level to a high level. The control circuit ends the swing boost mode and enters a clock training mode when the source driving circuit causes loss of lock to the data signal in the swing boost mode. In the clock training mode, the control circuit controls the transmitter circuit to employ a clock training data string as the data signal to transmit to the source driving circuit.

16 Claims, 10 Drawing Sheets

TIMING CONTROLLER AND OPERATION METHOD THEREOF

CROSS-REFERENCE TO RELATED APPLICATION

This application claims the priority benefit of U.S. provisional application Ser. No. 62/624,073, filed on Jan. 30, 2018. The entirety of the above-mentioned patent application is hereby incorporated by reference herein and made a part of this specification.

BACKGROUND

Field of the Invention

The invention relates to a display apparatus and more particularly to a timing controller and an operation method thereof.

Description of Related Art

When a mobile phone (or any other radio frequency (RF) device) approaches a display apparatus, a RF noise may cause the occurrence of abnormality to a display screen of the display apparatus. One of the reasons that cause the occurrence of abnormality is that the RF noise of the mobile phone may interfere data signal transmission between a timing controller and a source driving circuit.

FIG. 1 is a schematic diagram of a scenario where a mobile phone 110 approaches a display apparatus 120. A timing controller 121 transmits a data signal to a source driving circuit 122 through a transmission line, and the source driving circuit 122 drives a display panel according to the data signal to display an image. When the mobile phone 110 approaches the display apparatus 120, a RF noise 111 of the mobile phone 110 may interfere the transmission of the data signal between a timing controller 121 and a source driving circuit 122. When the energy of the RF noise in the data signal is sufficiently large, the source driving circuit 122 may fail to correctly latch the data signal.

FIG. 2 is a schematic diagram of a scenario where a signal received by the source driving circuit 122 depicted in FIG. 1 is interfered by the RF noise. In FIG. 2, the horizontal axis represents the time, Rx represents the data signal and/or the output clock received by the source driving circuit 122, and CDR_CLK represents a clock signal received by a clock data recovery (CDR) circuit disposed inside the source driving circuit 122. As illustrated in the left part of FIG. 2, when the RF noise 111 does not yet occur, the CDR circuit disposed inside the source driving circuit 122 may correctly lock the data signal Rx, i.e., a phase of the data signal Rx matches a phase of the clock signal CDR_CLK. When the RF noise 111 occurs, the RF noise 111 may interfere the data signal Rx, such that the phase of the data signal Rx does not match the phase of the clock signal CDR_CLK. Namely, the CDR circuit disposed inside the source driving circuit 122 may cause loss of lock to the data signal Rx. When the source driving circuit 122 fails to correctly lock the data signal Rx, the display panel of the display apparatus 120 certainly fails to display a correct image.

SUMMARY

The invention provides a timing controller and an operation method thereof capable of dynamically adjusting a swing of a data signal according to a lock signal fed back by a source driving circuit.

According to an embodiment of the invention, a timing controller is provided. The timing controller includes a transmitter circuit and a control circuit. The transmitter circuit transmits a data signal to a source driving circuit. The control circuit controls the transmitter circuit to adjust a swing of the data signal. In a condition that the control circuit is operated in a normal mode, the control circuit ends the normal mode and enters a swing boost mode when a lock signal fed back by the source driving circuit indicates that quality of the data signal is deteriorated. In the swing boost mode, the control circuit controls the transmitter circuit to boost the swing of the data signal from a normal level to a high level. In a condition that the control circuit is operated in the swing boost mode, the control circuit enters a clock training mode when the lock signal fed back by the source driving circuit indicates that the data signal has loss of lock. In the clock training mode, the control circuit controls the transmitter circuit to employ a clock training data string as the data signal to transmit to the source driving circuit.

According to an embodiment of the invention, an operation method of a timing controller is provided. The operation method comprises: transmitting a data signal to a source driving circuit by a transmitter circuit; in a condition that the timing controller is operated in a normal mode, ending the normal mode to enter a swing boost mode when a lock signal fed back by the source driving circuit indicates that quality of the data signal is deteriorated; boosting a swing of the data signal from a normal level to a high level by the transmitter circuit in the swing boost mode; in a condition that the timing controller is operated in the swing boost mode, entering a clock training mode when the lock signal fed back by the source driving circuit indicates that the data signal has loss of lock; and employing a clock training data string as the data signal to transmit to the source driving circuit by the transmitter circuit in the clock training mode.

To sum up, in the timing controller and the operation method thereof provided by the embodiments of the invention, the control circuit is determined to be operated in the normal mode, the swing boost mode or other modes according to the lock signal fed back by the source driving circuit. In the normal mode, the control circuit controls the transmitter circuit to transmit the data signal at the normal level (i.e., a normal swing) to the source driving circuit. In the swing boost mode, the control circuit controls the transmitter circuit to transmit the data signal at the high level (i.e., a boosted swing) to the source driving circuit. Thus, the timing controller can dynamically adjust the swing of the data signal according to the lock signal fed back by the source driving circuit.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
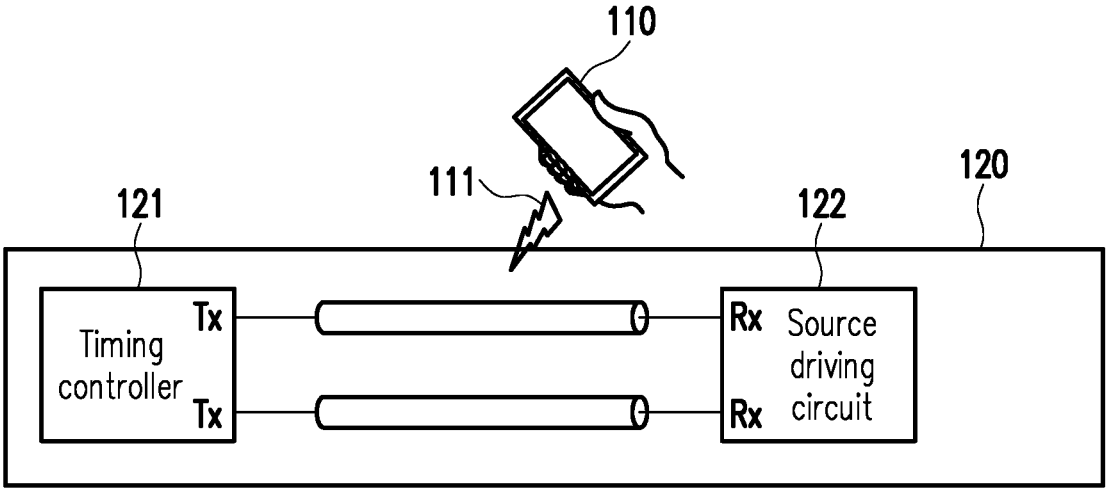
FIG. 1 (RELATED ART)
FIG. 1 is a schematic diagram of a scenario where a mobile phone approaches a display apparatus.
Figure 2:
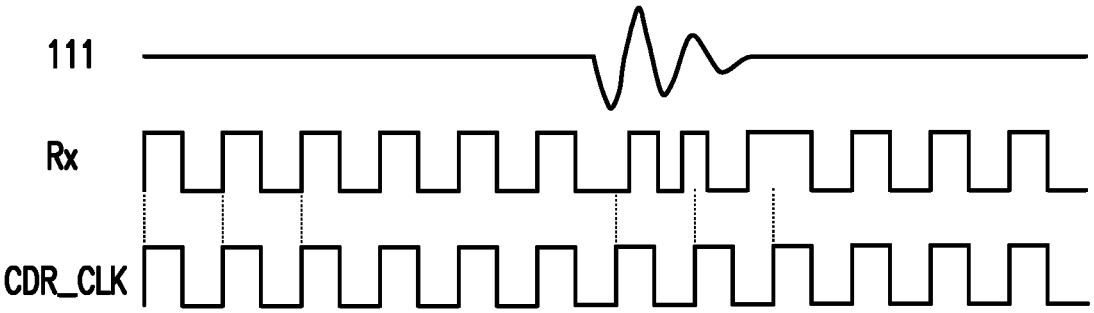
FIG. 2 (RELATED ART)
FIG. 2 is a schematic diagram of a scenario where a signal received by the source driving circuit depicted in FIG. 1 is interfered by the radio frequency (RF) noise.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments. Elements/components/notations with the same reference numerals in different embodiments may be referenced to the related description.

Figure 3:
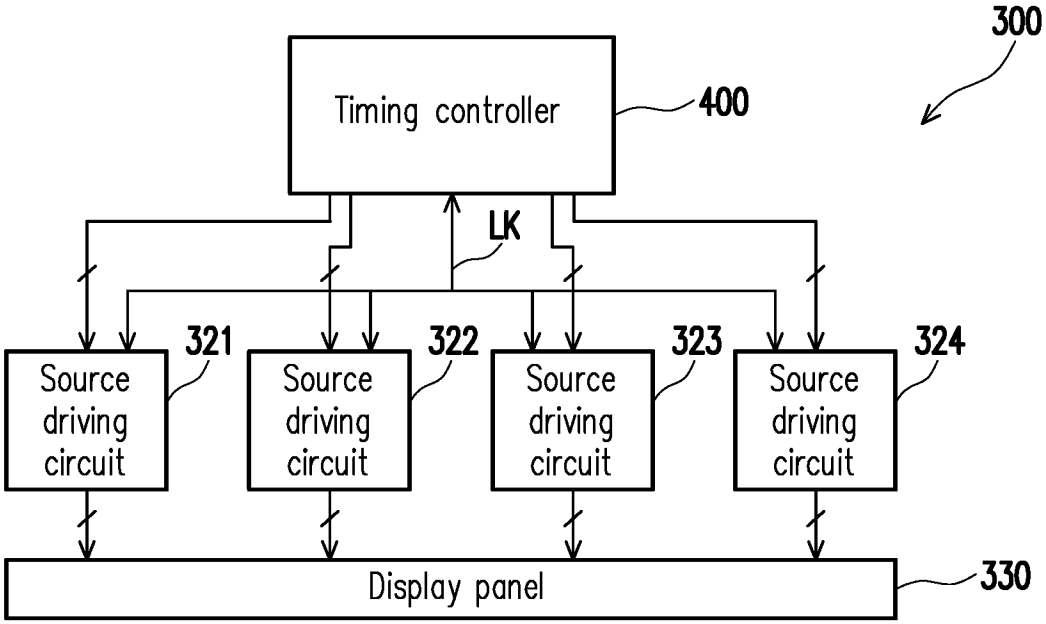
FIG. 3 is a schematic circuit block diagram of a display apparatus according to an embodiment of the invention.

FIG. 3 is a schematic circuit block diagram illustrating a display apparatus 300 according to an embodiment of the invention. The display apparatus 300 includes a timing controller 400, a plurality of source driving circuits (for example, source driving circuits 321, 322, 323 and 324 illustrated in FIG. 3) and a display panel 330. FIG. 3 illustrates 4 source driving circuits 321-324, however, in any way, the number of the source driving circuits may be determined based on a design requirement. The timing controller 400 transmits data signals to the source driving circuits 321-324 through transmission lines, and the source driving circuits 321-324 drive the display panel 330 according to the data signals to display images.

Clock data recovery (CDR) circuits disposed inside the source driving circuits 321-324 receive the data signals from the timing controller 400. The CDR circuits disposed inside the source driving circuits 321-324 may parse clocks and data from the data signals provided by the timing controller 400. When a radio frequency (RF) noise does not yet occur, or the energy of the RF noise is still insufficient for causing interference to the data signals, the CDR circuits disposed inside the source driving circuits 321-324 may correctly lock the data signals provided by the timing controller 400. In this circumstance, the CDR circuits disposed inside the source driving circuits 321-324 may feed back information indicating that "the data signal is correctly locked" to the timing controller 400 via a lock signal LK.

When the RF noise occurs, or the energy of the RF noise is sufficient for causing interference to the data signals, the CDR circuits disposed inside the source driving circuits 321-324 may probably fail to correctly lock the data signals provided by the timing controller 400. When the source driving circuits 321-324 fail to correctly lock the data signals, the display panel 330 of the panel display apparatus 300 certainly fails to display a correct image. Thus, when the CDR circuits disposed inside the source driving circuits 321-324 fail to correctly lock the data signals provided by the timing controller 400, the CDR circuits disposed inside the source driving circuits 321-324 may feed back information indicating that "the data signal has loss of lock" to the timing controller 400 via the lock signal LK.

Figure 4:
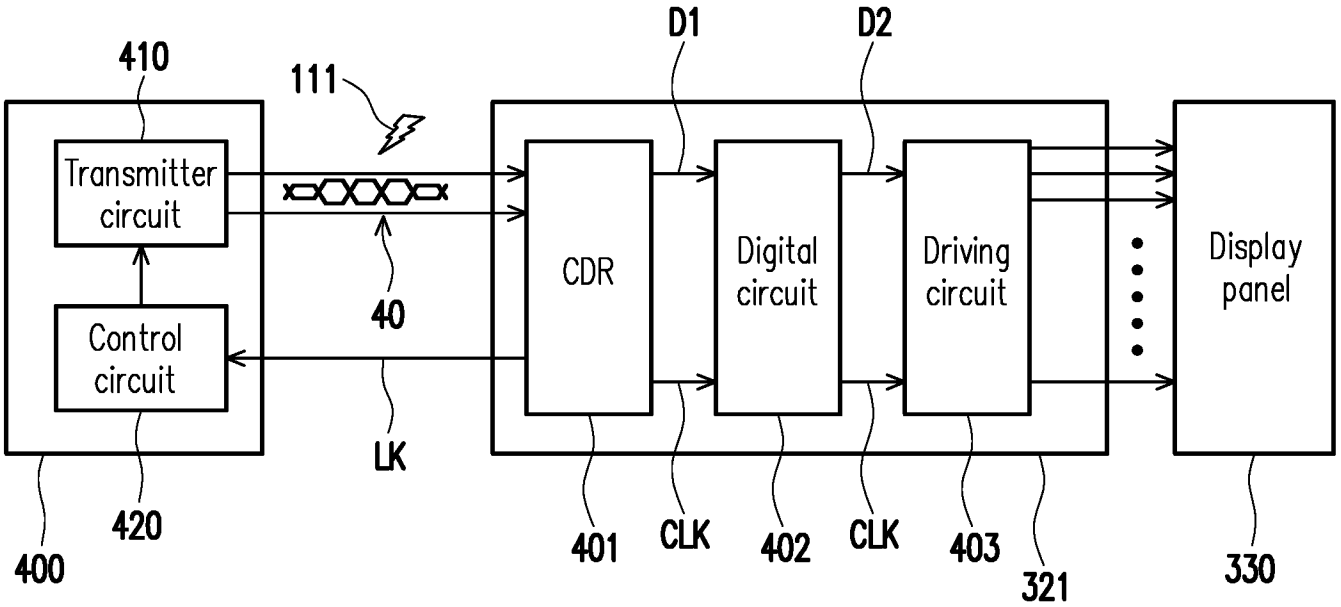
FIG. 4 is a schematic circuit block diagram of the timing controller and the source driving circuit depicted in FIG. 3 according to an embodiment of the invention.

FIG. 4 is a schematic circuit block diagram of the timing controller 400 and the source driving circuit 321 depicted in FIG. 3 according to an embodiment of the invention. In FIG. 4, the source driving circuit 321 is illustrated, while the other source driving circuits (for example, the source driving circuits 322-324) may refer to the description related to the source driving circuit 321 and thus, will not be repeated. In the embodiment illustrated in FIG. 4, the timing controller 400 includes a transmitter circuit 410 and a control circuit 420. Based on a design requirement, the timing controller 400 may include a phase-locked loop (PLL), a parallel to serial circuit, an encoder circuit, an output buffer and/or other circuits/elements. In some embodiments, the transmitter circuit 410 may be a conventional transmitter circuit or other transmitters. The transmitter circuit 410 may transmit a data signal 40 to the source driving circuit 321. The control circuit 420 may control the transmitter circuit 410 to adjust a swing of the data signal 40.

In the embodiment illustrated in FIG. 4, the source driver circuit 321 includes a clock data recovery (CDR) circuit 401, a digital circuit 402 and a driving circuit 403. The CDR circuit 401 may parse a clock CLK and data D1 from the data signal 40 provided by the timing controller 400. In some embodiments, the CDR circuit 401 may be a conventional CDR circuit or other CDR circuits. The digital circuit 402 may process the data D1, so as to generate a processed data signal D2, for example, pixel data. Based on a design requirement, the digital circuit 402 may include a decoder circuit, a serial to parallel circuit and/or other circuits/elements. In some embodiments, the digit circuit 402 may be a conventional digit circuit. The driving circuit 403 may drive the display panel 330 according to the clock signal CLK and the data signals D2. Based on a design requirement, the driving circuit 403 may include a shift register, a data register, a level shifter, a digital-to-analog converter (DAC) and an output buffer. In some embodiments, the driving circuit 403 may be a conventional driving circuit or another driving circuit.

When a radio frequency (RF) noise 111 does not yet occur, or the energy of the RF noise 111 is still insufficient for causing interference to the data signal 40, the CDR circuit 401 may correctly lock the data signal provided by the timing controller 400. In this circumstance, the CDR circuit 401 may feed back information indicating that "the data signal is correctly locked" to the timing controller 400 via the lock signal LK. When a mobile phone approaches the display apparatus 300, the RF noise 111 of the mobile phone may interfere the transmission of the data signal 40 between the timing controller 400 and the source driving circuit 321. When the energy of the RF noise in the data signal 40 is sufficiently large, the CDR circuit 401 may probably fail to correctly lock the data signal 40. When the CDR circuit 401 fails to correctly lock the data signal 40, the CDR circuit 401 may feed back information indicating that "the data signal has loss of lock" to the timing controller 400 via the lock signal LK.

Figure 5:
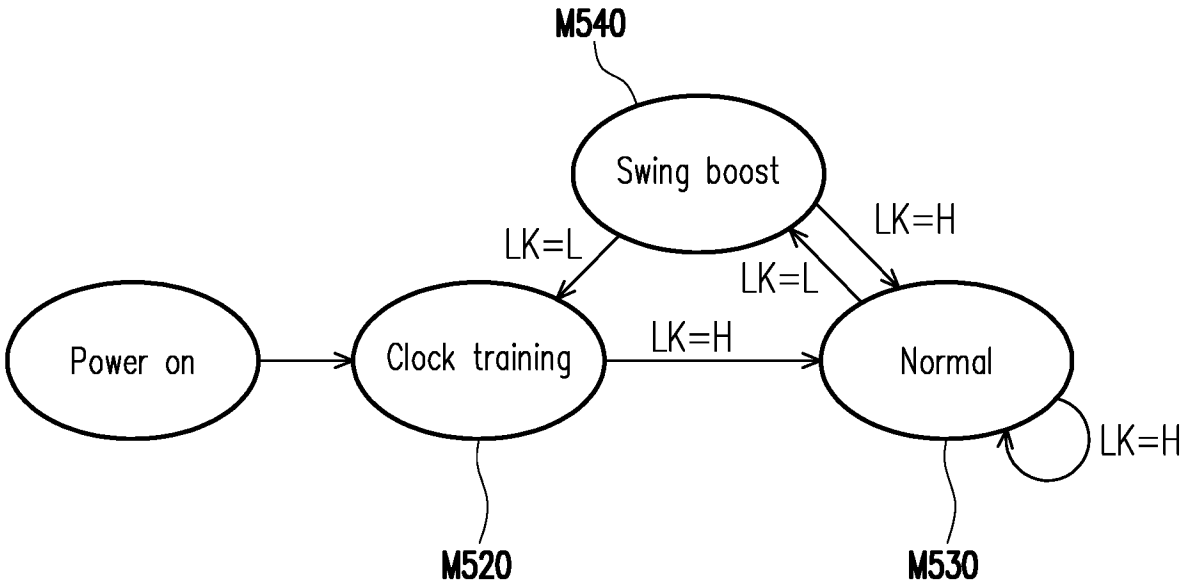
FIG. 5 is a schematic state diagram according to an embodiment of the invention.

FIG. 5 is a schematic state diagram according to an embodiment of the invention. In the embodiment illustrated in FIG. 5, the lock signal LK having a high logic level H is defined that "the data signal is correctly locked", and the lock signal LK having a low logic level L is defined that "the data signal has loss of lock of signal". However, in other embodiments, the lock signal LK having the low logic level L may indicate that "the data signal has loss of lock of signal", and the lock signal LK having the low logic level L may indicate that "the data signal is correctly locked".

Referring to FIG. 4 and FIG. 5, after the display apparatus 300 is powered on, the control circuit 402 enters a clock training mode M520. In a clock training mode M520, the control circuit 420 controls the transmitter circuit 410 to employ a clock training data string as the data signal 40 to transmit to the source driving circuit. The operation details of the timing controller 400 in the clock training mode M520 are not limited in the present embodiment. For instance, the operation details of the clock training mode M520 may include a conventional clock training operation or other operations. In this circumstance, the CDR circuit 401 may perform a frequency lock operation and/or a phase lock operation on the clock training data string provided by the timing controller 400.

When the CDR circuit 401 may correctly lock the clock training data string provided by the timing controller 400, the CDR circuit 401 may pull the lock signal LK up to the high logic level H, so as to indicate that "the data signal is correctly locked". In a condition that the control circuit 420 is operated in the clock training mode M520, the control circuit 420 ends the clock training mode M520 to enter a normal mode M530 when the lock signal LK fed back by the source driving circuit 321 is pulled up to the high logic level H (which indicates that the data signal 40 is locked). In the normal mode M530, the control circuit 420 controls the transmitter circuit 410 to transmit the data signal at a normal level (i.e., a normal swing) to the source driving circuit 321.

Figure 6:
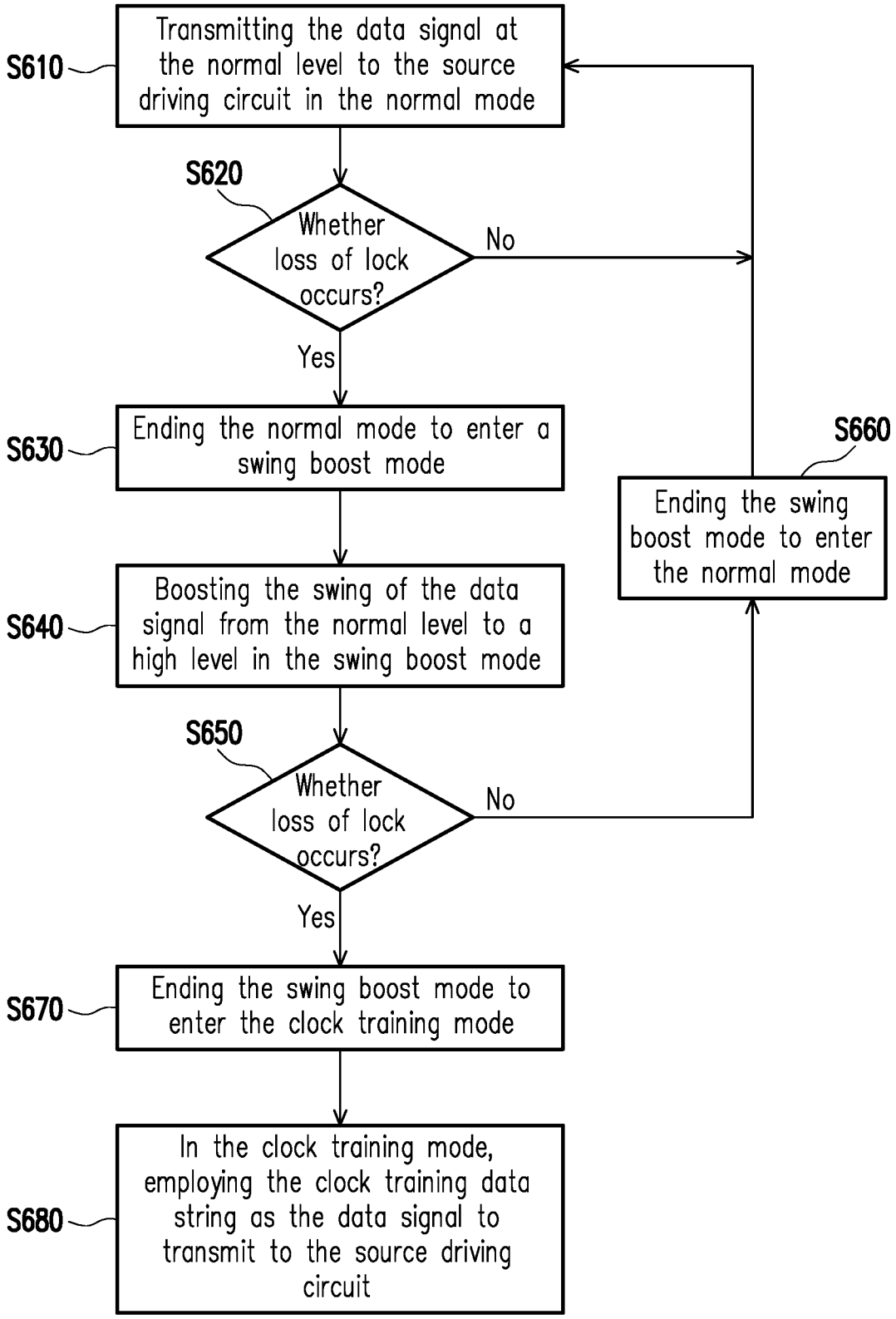
FIG. 6 is a flowchart of an operation method of a timing controller according to an embodiment of the invention.

FIG. 6 is a flowchart of an operation method of a timing controller according to an embodiment of the invention. Referring to FIG. 4, FIG. 5 and FIG. 6, in a condition that the control circuit 420 is operated in the normal mode M530, the control circuit 420 controls the transmitter circuit 410 to transmit the data signal at the normal level (i.e., the normal swing) to the source driving circuit 321 (step S610). The control circuit 420, in step S620, determines a logic level of the lock signal LK. When the lock signal LK is maintained at the high logic level H, i.e., the CDR circuit 401 does not cause loss of lock to the data signal 40 (i.e., it is determined as "No" in step S620), the control circuit 420 is maintained in the normal mode M530, and the transmitter circuit 410 transmits the data signal 40 at the normal level (i.e., the normal swing) to the source driving circuit 321 (step S610).

When the mobile phone approaches the display apparatus 300, the RF noise 111 of the mobile phone may interfere the transmission of the data signal 40 between the timing controller 400 and the source driving circuit 321. When the energy of the RF noise in the data signal 40 is sufficiently large, the CDR circuit 401 may probably fail to correctly lock the data signal 40. When the CDR circuit 401 fails to correctly lock the data signal 40, the CDR circuit 401 may pull the lock signal LK down to the low logic level L. In the condition that the control circuit 420 is operated in the normal mode M530, the control circuit 420 ends the normal mode M530 to enter a swing boost mode M540 when the lock signal LK fed back by the source driving circuit 321 is pulled down to the low logic level L, i.e., the CDR circuit 401 causes loss of lock to the data signal 40 (i.e., it is determined as "Yes" in step S620) (step S630). In the swing boost mode M540, the control circuit 420 controls the transmitter circuit 410 to boost the swing of the data signal 40 from the normal level to a high level (step S640).

Figure 7:
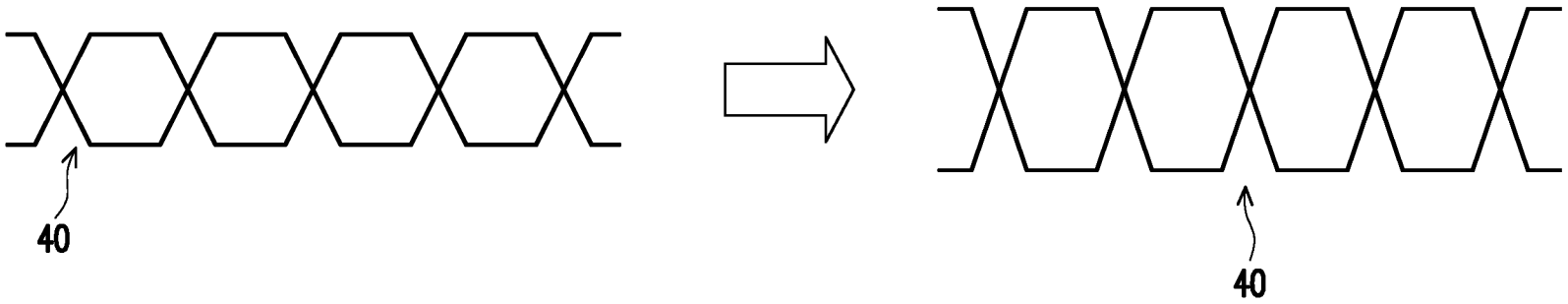
FIG. 7 is a schematic diagram illustrating that the swing of the data signal is boosted from a normal level to a high level according to an embodiment of the invention.

FIG. 7 is a schematic diagram illustrating that the swing of the data signal 40 is boosted from the normal level to a high level according to an embodiment of the invention. The left part of FIG. 7 illustrates an eye diagram of the data signal 40 having a normal level (i.e., a normal swing), and the right part of FIG. 7 illustrates an eye diagram of the data signal 40 having a high level (i.e., a large swing). In the swing boost mode M540, the control circuit 420 controls the transmitter circuit 410 to boost the swing of the data signal 40 from the normal level to the high level, as illustrated in FIG. 7. "Enlarging the swing" may make the data signal 40 stronger (i.e., have stronger anti-interference capability). Usually, the CDR circuit 401 may correctly lock the data signal 40 whose swing is enlarged.

Referring to FIG. 4, FIG. 5 and FIG. 6, when the CDR circuit 401 causes loss of lock to the data signal 40, the swing of the data signal 40 may be enlarged in the swing boost mode M540 (step S640). However, the data signal 40 having the enlarged swing may likely be a source of electromagnetic interference (EMI) or a radio frequency interference (RFI). Thus, the control circuit 420, in step S650, determines the logic level of the lock signal LK. In a condition that the control circuit 420 is operated in the swing boost mode M540, the control circuit 420 ends the swing boost mode M540 to enter the normal mode M530 when the lock signal LK is pulled up to the high logic level H, i.e., the CDR circuit 401 does not cause loss of lock to the data signal 40 (i.e., it is determined as "No" in step S650) (step S640), and the transmitter circuit 410 resumes to transmit the data signal 40 at the normal level (i.e., the normal swing) to the source driving circuit 321 (step S610). The reduction of the swing of the data signal 40 may contribute to improving the issue of EMI or RFI.

In the condition that the control circuit 420 is operated in the swing boost mode M540, the control circuit 420 ends the swing boost mode M540 to enter the clock training mode M520 when the lock signal LK fed back by the source driving circuit 321 is still at the low level, i.e., the CDR circuit 401 still causes loss of lock to the data signal 40 (i.e., it is determined as "Yes" in step S650) (step S670). In the clock training mode M520, the control circuit 420 controls the transmitter circuit 410 to employ the clock training data string as the data signal 40 to transmit to the source driving circuit 321 (step S680).

Figure 8:
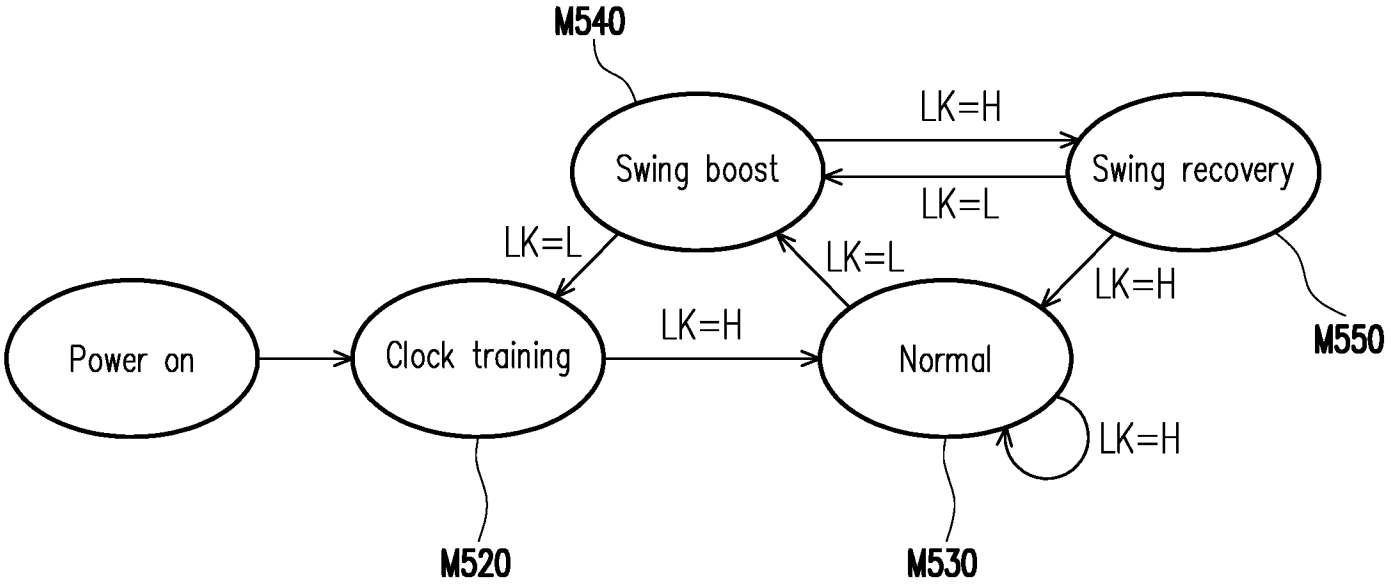
FIG. 8 is a schematic state diagram according to another embodiment of the invention.

FIG. 8 is a schematic state diagram according to another embodiment of the invention. The clock training mode M520, the normal mode M530 and the swing boost mode M540 illustrated in FIG. 8 may be inferred with reference to the descriptions related to the embodiment illustrated in FIG. 5 and thus, will not be repeated. In the embodiment illustrated in FIG. 8, the lock signal LK having the high logic level H is defined that "the data signal is correctly locked", and the lock signal LK having the low logic level L is defined that "the data signal has loss of lock of signal". However, in other embodiments, the lock signal LK having the high logic level H may indicate that "the data signal has loss of lock of signal", and the lock signal LK having the low logic level L may indicate that "the data signal is correctly locked".

Referring to FIG. 4 and FIG. 8, when the CDR circuit 401 fails to correctly lock the data signal 40, the CDR circuit 401 may pull the lock signal LK down to the low logic level L. In the condition that the control circuit 420 is operated in the normal mode M530, the control circuit 420 ends the normal mode M530 to enter the swing boost mode M540 when the lock signal LK fed back by the source driving circuit 321 is at the low logic level L. In the swing boost mode M540, the control circuit 420 controls the transmitter circuit 410 to boost the swing of the data signal 40 from the normal level to a high level. In the condition that the control circuit 420 is operated in the swing boost mode M540, the control circuit 420 keeps being operated in the swing boost mode M540 when the lock signal LK fed back by the source driving circuit 321 is at the high logic level H (which indicates that the data signal 40 is locked) until entering a pre-specified period. Based on a design requirement, the pre-specified period includes, for example, a vertical blank period or any other period. Different implementation examples with respect to the pre-specified period will be described with reference to FIG. 9 to FIG. 14 below. During the pre-specified period (for example, a vertical blank period), if the lock signal LK is still at the high logic level H, the control circuit 420 ends the swing boost mode M540 to enter a swing recovery mode M550.

In the swing recovery mode M550, the control circuit 420 controls the transmitter circuit 410 to drop the swing of the data signal 40 from the high level (i.e., the large swing) down to the normal level (i.e., the normal swing). In a condition that the control circuit 420 is operated in the swing recovery mode M550, the control circuit 420 ends the swing recovery mode M550 and enters the normal mode M530 when the lock signal LK fed back by the source driving circuit 321 is still at the high logic level H (which indicates that the data signal 40 is locked). In the condition that the control circuit 420 is operated in the swing recovery mode M550, the control circuit 420 ends the swing recovery mode M550 and enters the swing boost mode M540 when the lock signal LK fed back by the source driving circuit 321 is pulled down to the low logic level L (which indicates that the data signal 40 has loss of lock).

Figure 9:
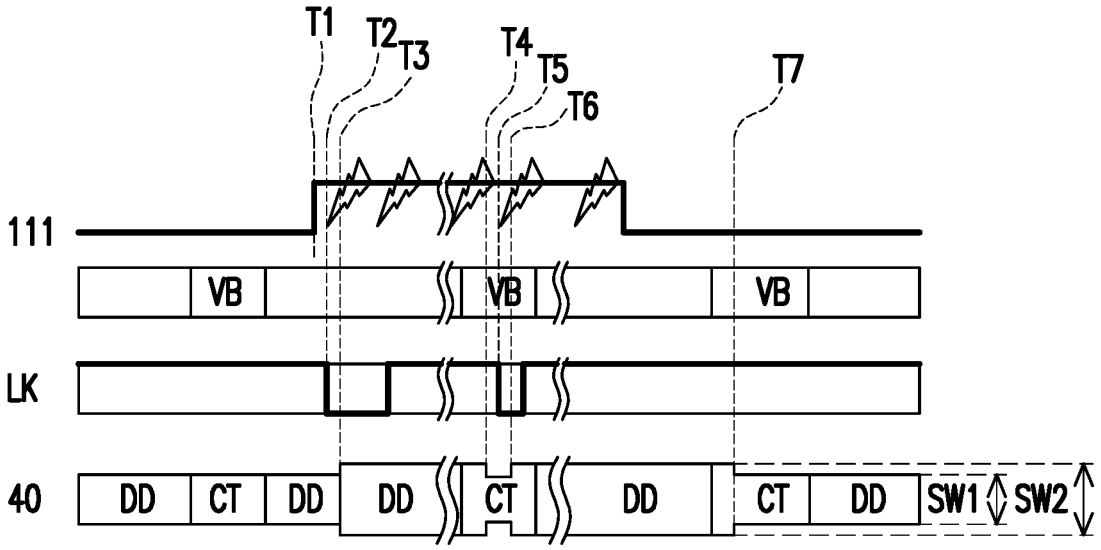
FIG. 9 is a schematic signal timing diagram of the timing controller depicted in FIG. 4 according to an embodiment of the invention.

FIG. 9 is a schematic signal timing diagram of the timing controller 400 depicted in FIG. 4 according to an embodiment of the invention. In FIG. 9, the horizontal axis represents the time, VB represents a vertical blank period between two frames, DD represents display data (i.e., a pixel data string), and CT represents a clock training data string. In the embodiment illustrated in FIG. 9, the lock signal LK having the high logic level H is defined as "in a locked state", and the lock signal LK having the low logic level L is defined as "in a loss of lock state".

Referring to FIG. 4 and FIG. 9, the RF noise 111 occurs at a time T1 illustrated in FIG. 9, and the RF noise 111 may interfere the data signal 40. When the quality of the data signal 40 is deteriorated, the CDR circuit 401 may pull the lock signal LK down to the low logic level L at a time T2 illustrated in FIG. 9. In the condition that the control circuit 420 is operated in the normal mode M530, the control circuit 420 ends the normal mode M530 to enter the swing boost mode M540 when the lock signal LK is at the low logic level L, such that the transmitter circuit 410 may boost the swing of the data signal 40 from a normal level (i.e., a normal swing SW1) to a high level (i.e., a large swing SW2) at a time T3 illustrated in FIG. 9. In an initial stage of the swing boost mode M540, the transmitter circuit 410 keeps employing the pixel data string (i.e., display data DD) as the data signal 40 to transmit to the source driving circuit 321. After the swing of the data signal 40 is boosted to the large swing SW2 (after the time T3), the CDR circuit 401 may correctly lock the data signal 40 with the enlarged swing and thus, may pull the lock signal LK up to the high logic level H. In the embodiment illustrated in FIG. 9, even though the lock signal LK is pulled up to the high logic level H, the control circuit 420 is still maintained in the swing boost mode M540 until entering the vertical blank period VB.

During the vertical blank period VB, based on the lock signal LK at the high logic level H, the control circuit 420 ends the swing boost mode M540 to enter the swing recovery mode M550 at a time T4. In the swing recovery mode M550, the control circuit 420 controls the transmitter circuit 410 to drop the swing of the data signal 40 from the high level (i.e., the large swing SW2) down to the normal level (i.e., the normal swing SW1). After the swing of the data signal 40 is dropped down to the normal swing SW1, the quality of the data signal 40 is deteriorated again (i.e., causes loss of lock) because the RF noise 111 still exists. When the CDR circuit 401 again causes loss of lock, the CDR circuit 401 may again pull the lock signal LK down to the low logic level L at a time T5 illustrated in FIG. 9. In the condition that the control circuit 420 is operated in the swing recovery mode M550, the control circuit 420 ends the swing recovery mode M550 to enter the swing boost mode M540 when the lock signal LK is at the low logic level L, such that the transmitter circuit 410 again boosts the swing of the data signal 40 from the normal level (i.e., the normal swing SW1) to the high level (i.e., the large swing SW2) at a time T6 illustrated in FIG. 9.

The aforementioned operations are repeatedly performed until the RF noise 111 disappears (or the energy of the RF noise 111 is no longer sufficient for interfering the data signal 40). For example, at a time T7 illustrated in FIG. 9, based on the lock signal LK at the high logic level H, the control circuit 420 ends the swing boost mode M540 to enter the swing recovery mode M550 during the vertical blank period VB. The transmitter circuit 410 drops the swing of the data signal 40 from the large swing SW2 down to the normal swing SW1. Because the RF noise 111 disappears (or the energy of the RF noise 111 is no longer sufficient for interfering the data signal 40), the CDR circuit 401 still may correctly lock the data signal 40 after the swing of the data signal 40 is dropped down to the large swing SW1. Thus, the lock signal LK is maintained at the high logic level H. In the condition that the control circuit 420 is operated in the swing recovery mode M550, the control circuit 420 ends the swing recovery mode M550 and returns to the normal mode M530 when the lock signal LK is still at the high logic level H.

Figure 10:
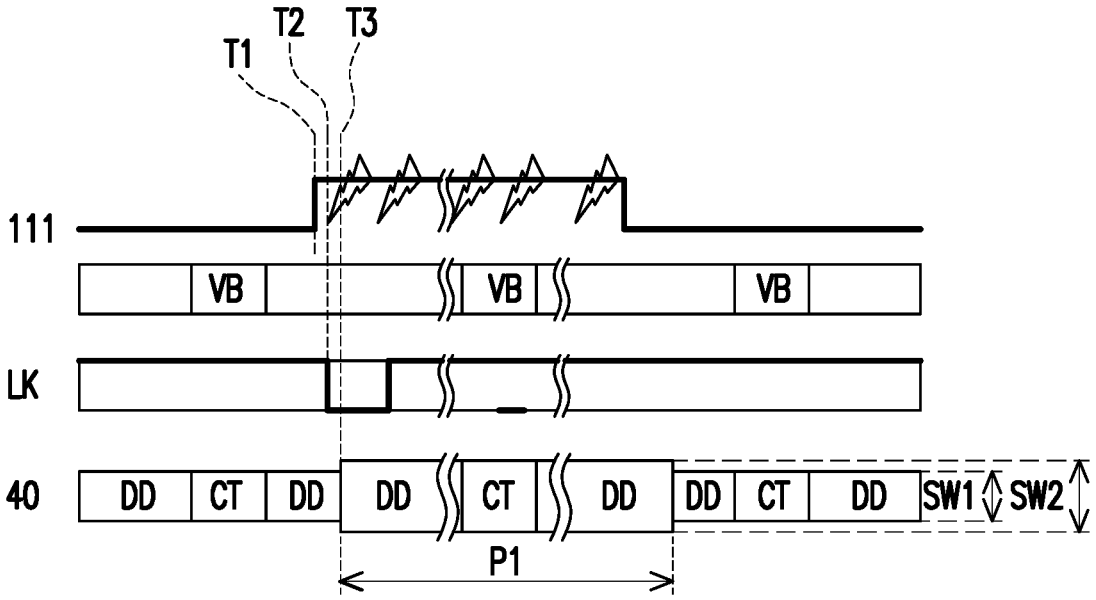
FIG. 10 is a schematic signal timing diagram of the timing controller depicted in FIG. 4 according to another embodiment of the invention.

FIG. 10 is a schematic signal timing diagram of the timing controller 400 depicted in FIG. 4 according to another embodiment of the invention. In FIG. 10, the horizontal axis represents the time, VB represents the vertical blank period between two frames, DD represents the display data (i.e., the pixel data string), and CT represents the clock training data string. In the embodiment illustrated in FIG. 10, the lock signal LK having the high logic level H is defined as "in the locked state", and the lock signal LK having the low logic level L is defined as "the quality of the data signal 40 is deteriorated". In other embodiments, the lock signal LK having the low logic level L is defined as "in the loss of lock state". Related operations at times T1, T2 and T3 illustrated in FIG. 10 may refer to the description related to those at the times T1, T2 and T3 illustrated in FIG. 9 and thus, will not be repeated.

Referring to FIG. 4 and FIG. 10, in the condition that the control circuit 420 is operated in the swing boost mode M540, the transmitter circuit 410 boosts the swing of the data signal 40 from the normal swing SW1 to the large swing SW2 at the time T3 illustrated in FIG. 3. In the initial stage of the swing boost mode M540, the transmitter circuit 410 continues to employ the pixel data string (i.e., the display data DD) as the data signal 40 to transmit to the source driving circuit 321. After the swing of the data signal 40 is boosted to the large swing SW2 (after the time T3), the CDR circuit 401 may correctly lock the data signal 40 with the enlarged swing and thus, may pull the lock signal LK up to the high logic level H. In the embodiment illustrated in FIG. 10, in the condition that the control circuit 420 is operated in the swing boost mode M540, even though the lock signal LK is pulled up to the high logic level H (which indicates that the data signal 40 is locked), the control circuit 420 keeps being operated in the swing boost mode M540 until a noise preventing period P1 ends. A time length of the noise preventing period P1 may be determined based on a design requirement.

When the noise preventing period P1 ends, the control circuit 420 ends the swing boost mode M540 to enter the swing recovery mode M550. In the swing recovery mode M550, the control circuit 420 controls the transmitter circuit 410 to drop the swing of the data signal 40 from the high level (i.e., the large swing SW2) down to the normal level (i.e., the normal swing SW1). In the condition that the control circuit 420 is operated in the swing recovery mode M550, the control circuit 420 ends the swing recovery mode M550 to enter the normal mode M530 when the lock signal LK is maintained at the high logic level H (which indicates that the data signal 40 is locked).

Figure 11:
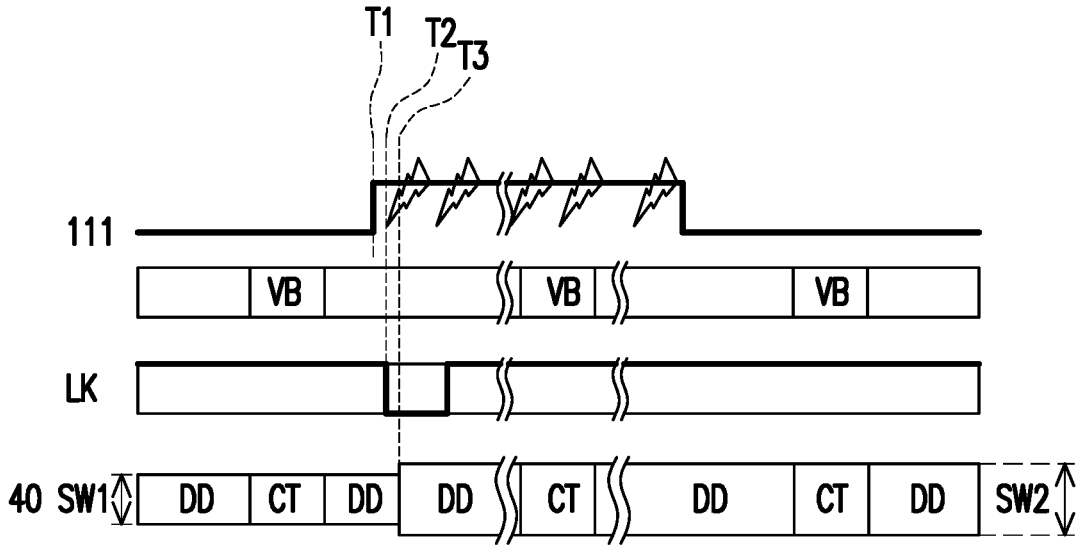
FIG. 11 is a schematic signal timing diagram of the timing controller depicted in FIG. 4 according to yet another embodiment of the invention.

FIG. 11 is a schematic signal timing diagram of the timing controller 400 depicted in FIG. 4 according to yet another embodiment of the invention. In FIG. 11, the horizontal axis represents the time, VB represents the vertical blank period between two frames, DD represents the display data (i.e., the pixel data string), and CT represents the clock training data string. In the embodiment illustrated in FIG. 11, the lock signal LK having the high logic level H is defined as "in the locked state", and the lock signal LK having the low logic level L is defined as "the quality of the data signal 40 is deteriorated". In other embodiments, the lock signal LK having the low logic level L is defined as "in the loss of lock state". Related operations at times T1, T2 and T3 illustrated in FIG. 11 may refer to the description related to those at the times T1, T2 and T3 illustrated in FIG. 9 and thus, will not be repeated.

Referring to FIG. 4 and FIG. 11, in the condition that the control circuit 420 is operated in the swing boost mode M540, the transmitter circuit 410 boosts the swing of the data signal 40 from the normal swing SW1 to the large swing SW2. In the initial stage of the swing boost mode M540, the transmitter circuit 410 continues to employ the pixel data string (i.e., the display data DD) as the data signal 40 to transmit to the source driving circuit 321. After the swing of the data signal 40 is boosted to the large swing SW2 (after the time T3), the CDR circuit 401 may correctly lock the data signal 40 with the enlarged swing and thus, may pull the lock signal LK up to the high logic level H. In the embodiment illustrated in FIG. 11, in the condition that the control circuit 420 is operated in the swing boost mode M540, even though the lock signal LK is pulled up to the high logic level H (which indicates that the data signal 40 is locked), the control circuit 420 keeps being operated in the swing boost mode M540 until the timing controller 400 is powered off.

Figure 12:
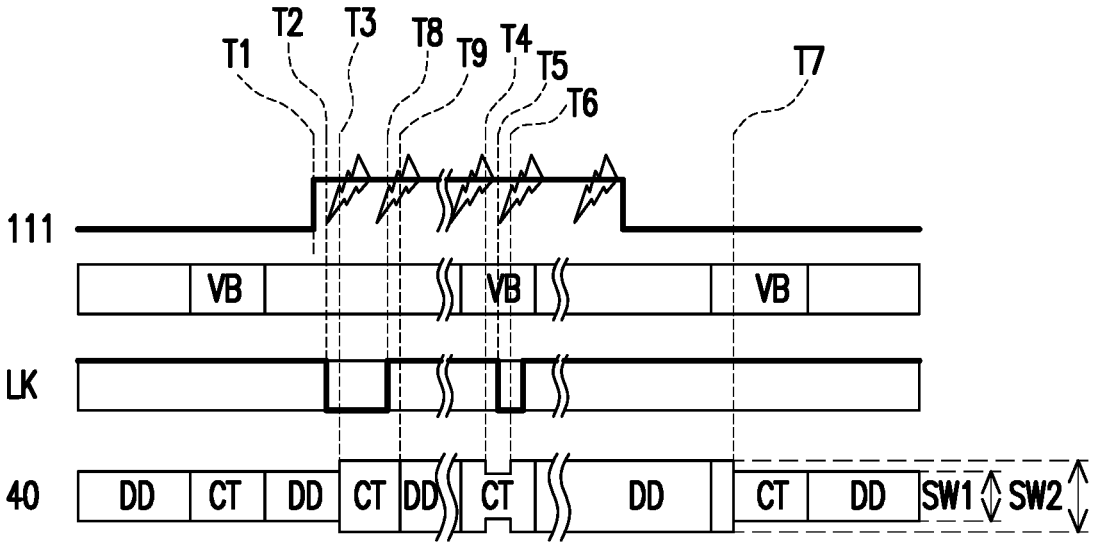
FIG. 12 is a schematic signal timing diagram of the timing controller depicted in FIG. 4 according to still another embodiment of the invention.

FIG. 12 is a schematic signal timing diagram of the timing controller 400 depicted in FIG. 4 according to still another embodiment of the invention. In FIG. 12, the horizontal axis represents the time, VB represents the vertical blank period between two frames, DD represents the display data (i.e., the pixel data string), and CT represents the clock training data string. In the embodiment illustrated in FIG. 12, the lock signal LK having the high logic level H is defined as "in the locked state", and the lock signal LK having the low logic level L is defined as "in the loss of lock state".

Referring to FIG. 4 and FIG. 12, the RF noise 111 occurs at a time T1 illustrated in FIG. 12, and the RF noise 111 may interfere the data signal 40. When the CDR circuit 401 fails to correctly lock the data signal 40, the CDR circuit 401 pulls the lock signal LK down to the low logic level L at a time T2 illustrated in FIG. 12. In the condition that the control circuit 420 is operated in the normal mode M530, the control circuit 420 ends the normal mode M530 to enter the swing boost mode M540 when the lock signal LK is at the low logic level L, such that the transmitter circuit 410 may boost the swing of the data signal 40 from the normal level (i.e., the normal swing SW1) to the high level (i.e., the large swing SW2) at a time T3 illustrated in FIG. 12. In the initial stage of the swing boost mode M540, the transmitter circuit 410 changes to employ the clock training data string CT as the data signal 40 to transmit to the source driving circuit 321. Thus, after the time T3, the CDR circuit 401 may perform a frequency lock operation and/or a phase lock operation on the clock training data string CT provided by the timing controller 400.

After the swing of the data signal 40 is boosted to the large swing SW2 (after the time T3), the CDR circuit 401 may correctly lock the data signal 40 with the enlarged swing (which is the clock training data string CT), and thus, the CDR circuit 401 pulls the lock signal LK up to the low logic level H at a time T8 illustrated in FIG. 12. Because the CDR circuit 401 is capable of correctly locking the data signal 40, the transmitter circuit 410 continues to employ the pixel data string (i.e., the display data DD) as the data signal 40 to transmit to the source driving circuit 321 at a time T9 illustrated in FIG. 12 until the control circuit 420 enters the vertical blank period VB. In the embodiment illustrated in FIG. 12, even though the lock signal LK is pulled up to the high logic level H, the control circuit 420 is still maintained in the swing boost mode M540 until entering the vertical blank period VB.

During the vertical blank period VB, based on the lock signal LK at the high logic level H, the control circuit 420 ends the swing boost mode M540 at the time T4 to enter the swing recovery mode M550. Related operations at times T4, T5, T6 and T7 illustrated in FIG. 12 may refer to the description related to those at the times T4, T5, T6 and T7 illustrated in FIG. 9 and thus, will not be repeated.

Figure 13:
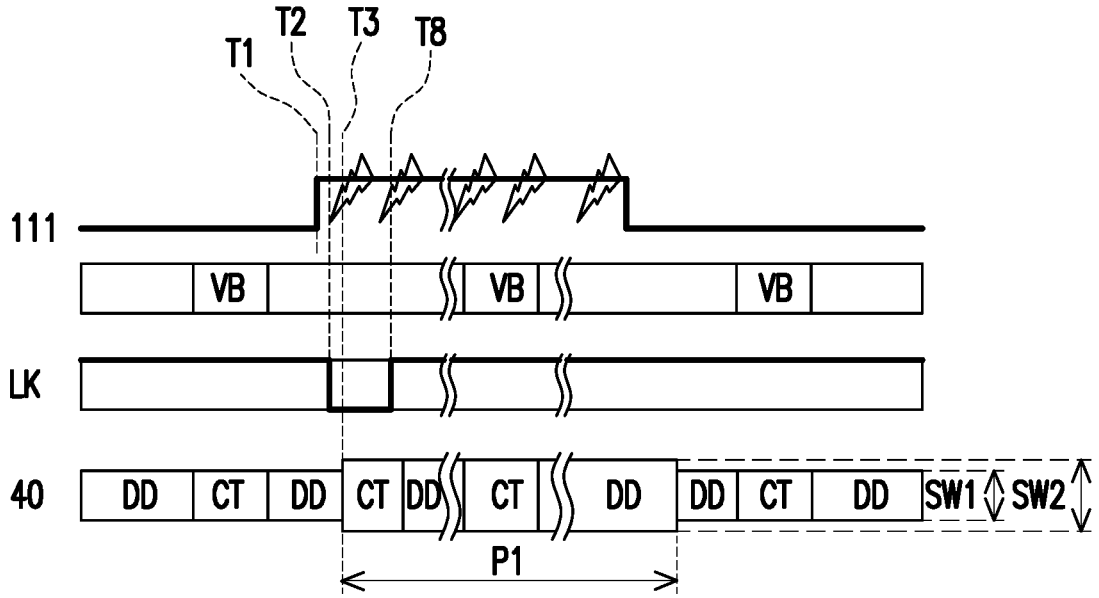
FIG. 13 is a schematic signal timing diagram of the timing controller depicted in FIG. 4 according to further another embodiment of the invention.

FIG. 13 is a schematic signal timing diagram of the timing controller 400 depicted in FIG. 4 according to further another embodiment of the invention. In FIG. 13, the horizontal axis represents the time, VB represents the vertical blank period between two frames, DD represents the display data (i.e., the pixel data string), and CT represents the clock training data string. In the embodiment illustrated in FIG. 13, the lock signal LK having the high logic level H is defined as "in the locked state", and the lock signal LK having the low logic level L is defined as "in the loss of lock state". Related operations at times T1, T2, T3, and T8 illustrated in FIG. 13 may refer to the description related to those at the times T1, T2, T3, and T8 illustrated in FIG. 12 and thus, will not be repeated.

Referring to FIG. 4 and FIG. 13, in the embodiment illustrated in FIG. 13, in the condition that the control circuit 420 is operated in the swing boost mode M540, even though the lock signal LK is pulled up to the high logic level H (which indicates that the data signal 40 is locked) at the time T8 illustrated in FIG. 13, the control circuit 420 keeps being operated in the swing boost mode M540 until the noise preventing period P1 ends. The time length of the noise preventing period P1 may be determined based on a design requirement. When the noise preventing period P1 ends, the control circuit 420 ends the swing boost mode M540 to enter the swing recovery mode M550. In the swing recovery mode M550, the control circuit 420 controls the transmitter circuit 410 to drop the swing of the data signal 40 from the high level (i.e., the large swing SW2) down to the normal level (i.e., the normal swing SW1). In the condition that the control circuit 420 is operated in the swing recovery mode M550, the control circuit 420 ends the swing recovery mode M550 to enter the normal mode M530 when the lock signal LK is maintained at the high logic level H (which indicates that the data signal 40 is locked).

Figure 14:
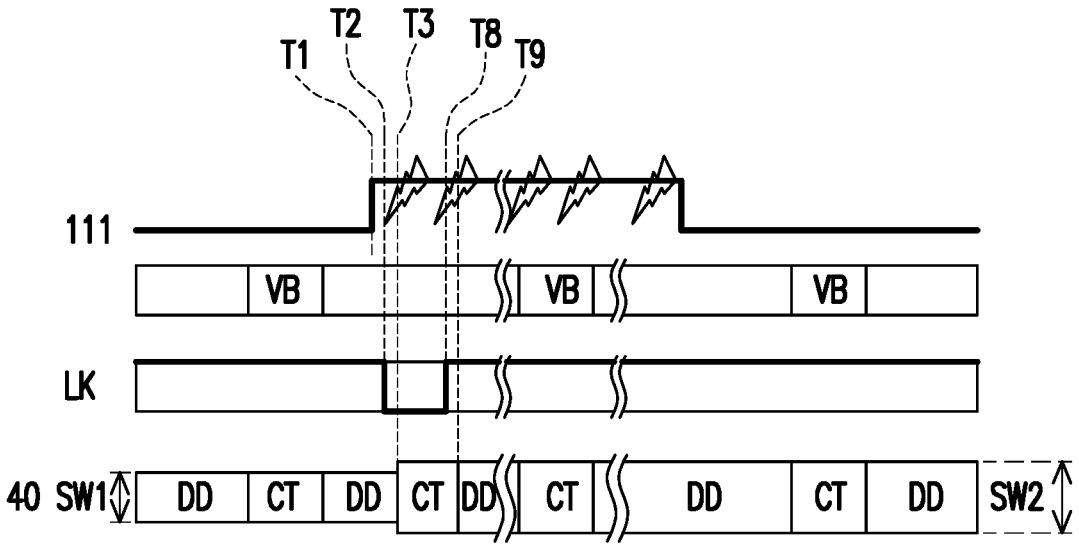
FIG. 14 is a schematic signal timing diagram of the timing controller depicted in FIG. 4 according to even another embodiment of the invention.

FIG. 14 is a schematic signal timing diagram of the timing controller 400 depicted in FIG. 4 according to even another embodiment of the invention. In FIG. 14, the horizontal axis represents the time, VB represents the vertical blank period between two frames, DD represents the display data (i.e., the pixel data string), and CT represents the clock training data string. In the embodiment illustrated in FIG. 14, the lock signal LK having the high logic level H is defined as "in the locked state", and the lock signal LK having the low logic level L is defined as "in the loss of lock state". Related operations at times T1, T2, T3, T8 and T9 illustrated in FIG. 14 may refer to the description related to those at the times T1, T2, T3, T8 and T9 illustrated in FIG. 12 and thus, will not be repeated.

Referring to FIG. 4 and FIG. 14, after the swing of the data signal 40 is boosted to the large swing SW2 (after the time T3), the CDR circuit 401 may correctly lock the data signal 40 with the enlarged swing and thus, may pull the lock signal LK up to the high logic level H at the time T8 illustrated in FIG. 14. In the embodiment illustrated in FIG. 14, in the condition that the control circuit 420 is operated in the swing boost mode M540, even though the lock signal LK is pulled up to the high logic level H (which indicates that the data signal 40 is locked), the control circuit 420 keeps being operated in the swing boost mode M540 until the timing controller 400 is powered off.

Based on different design demands, the blocks of the transmitter circuit 410 and/or the control circuit 420 may be implemented in a form of hardware, firmware, software (i.e., programs) or in a combination of many of the aforementioned three forms.

In terms of the hardware form, the blocks of the transmitter circuit 410 and/or the control circuit 420 may be implemented in a logic circuit on an integrated circuit. Related functions of the transmitter circuit 410 and/or the control circuit 420 may be implemented in a form of hardware by utilizing hardware description languages (e.g., Verilog HDL or VHDL) or other suitable programming languages. For example, the related functions of the transmitter circuit 410 and/or the control circuit 420 may be implemented in one or more controllers, micro-controllers, microprocessors, application-specific integrated circuits (ASICs), digital signal processors (DSPs), field programmable gate arrays (FPGAs) and/or various logic blocks, modules and circuits in other processing units.

In terms of the software form and/or the firmware form, the blocks of the transmitter circuit 410 and/or the control circuit 420 may be implemented as programming codes. For example, the transmitter circuit 410 and/or the control circuit 420 may be implemented by using general programming languages (e.g., C or C++) or other suitable programming languages. The programming codes may be recorded/stored in recording media. The aforementioned recording media include a read only memory (ROM), a storage device and/or a random access memory (RAM). Additionally, the programming codes may be accessed from the recording medium and executed by a computer, a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used. In addition, the programs may be provided to the computer (or the CPU) through any transmission medium (e.g., a communication network or radio waves). The communication network is, for example, the Internet, wired communication, wireless communication or other communication media.

Based on the above, in the timing controller and the operation method thereof provided by the embodiments of the invention, the control circuit can be determined to be operated in the normal mode, the swing boost mode or other modes according to the lock signal fed back by the source driving circuit. In the normal mode, the control circuit controls the transmitter circuit to transmit the data signal at the normal level (i.e., the normal swing) to the source driving circuit. In the swing boost mode, the control circuit controls the transmitter circuit to transmit the data signal at the high level (i.e., the enlarged swing) to the source driving circuit. Thus, timing controller can dynamically adjust the swing of the data signal according to the lock signal fed back by the source driving circuit.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A timing controller, comprising:

a transmitter circuit, transmitting a data signal to a source driving circuit; and a control circuit, controlling the transmitter circuit to adjust a swing of the data signal, wherein in a condition that the control circuit is operated in a normal mode, the control circuit ends the normal mode to enter a swing boost mode when a lock signal fed back by the source driving circuit indicates that quality of the data signal is deteriorated, the control circuit controls the transmitter circuit to boost the swing of the data signal from a normal level to a high level in the swing boost mode, in a condition that the control circuit is operated in the swing boost mode, the control circuit enters a clock training mode when the lock signal fed back by the source driving circuit indicates that the data signal has loss of lock, and the control circuit controls the transmitter circuit to employ a clock training data string as the data signal to transmit to the source driving circuit in the clock training mode.

2. The timing controller according to claim 1, wherein the transmitter circuit continues to employ a pixel data string as the data signal to transmit to the source driving circuit in an initial stage of the swing boost mode.

3. The timing controller according to claim 1, wherein the transmitter circuit continues to employ the clock training data string as the data signal to transmit to the source driving circuit in an initial stage of the swing boost mode.

4. The timing controller according to claim 1, wherein in the condition that the control circuit is operated in the clock training mode, the control circuit ends the clock training mode and enters the normal mode when the lock signal fed back by the source driving circuit indicates that the data signal is locked.

5. The timing controller according to claim 1, wherein in the condition that the control circuit is operated in the swing boost mode, the control circuit keeps being operated in the swing boost mode when the lock signal fed back by the source driving circuit indicates that the data signal is locked until entering a vertical blanking period;

the control circuit ends the swing boost mode to enter a swing recovery mode in the vertical blanking period;

the control circuit controls the transmitter circuit to drop the swing of the data signal from the high level down to the normal level in the swing recovery mode; and in a condition that the control circuit is operated in the swing recovery mode, the control circuit ends the swing recovery mode and enters the normal mode when the lock signal fed back by the source driving circuit indicates that the data signal is locked.

6. The timing controller according to claim 5, wherein in the condition that the control circuit is operated in the swing recovery mode, the control circuit ends the swing recovery mode and enters the swing boost mode when the lock signal fed back by the source driving circuit indicates that the quality of the data signal is deteriorated.

7. The timing controller according to claim 1, wherein in the condition that the control circuit is operated in the swing boost mode, the control circuit keeps being operated in the swing boost mode when the lock signal fed back by the source driving circuit indicates that the data signal is locked until a noise preventing period ends;

the control circuit ends the swing boost mode to enter a swing recovery mode when the noise preventing period ends;

the control circuit controls the transmitter circuit to drop the swing of the data signal from the high level down to the normal level in the swing recovery mode; and in a condition that the control circuit is operated in the swing recovery mode, the control circuit ends the swing recovery mode and enters the normal mode when the lock signal fed back by the source driving circuit indicates that the data signal is locked.

8. The timing controller according to claim 1, wherein in the condition that the control circuit is operated in the swing boost mode, the control circuit keeps being operated in the swing boost mode when the lock signal fed back by the source driving circuit indicates that the data signal is locked until the timing controller is powered off.

9. An operation method of a timing controller, comprising:

transmitting a data signal to a source driving circuit by a transmitter circuit;

in a condition that the timing controller is operated in a normal mode, ending the normal mode to enter a swing boost mode when a lock signal fed back by the source driving circuit indicates that the quality of the data signal is deteriorated;

boosting a swing of the data signal from a normal level to a high level by the transmitter circuit in the swing boost mode;

in a condition that the timing controller is operated in the swing boost mode, entering a clock training mode when the lock signal fed back by the source driving circuit indicates that the data signal has loss of lock; and employing a clock training data string as the data signal to transmit to the source driving circuit by the transmitter circuit in the clock training mode.

10. The operation method according to claim 9, further comprising:

continuing to employ a pixel data string as the data signal to transmit to the source driving circuit by the transmitter circuit in an initial stage of the swing boost mode.

11. The operation method according to claim 9, further comprising:

continuing to employ the clock training data string as the data signal to transmit to the source driving circuit by the transmitter circuit in an initial stage of the swing boost mode.

12. The operation method according to claim 9, further comprising:

in a condition that the timing controller is operated in the clock training mode, ending the clock training mode to enter the normal mode when the lock signal fed back by the source driving circuit indicates that the data signal is locked.

13. The operation method according to claim 9, further comprising:

in the condition that the timing controller is operated in the swing boost mode, keeping the timing controller operated in the swing boost mode when the lock signal fed back by the source driving circuit indicates that the data signal is locked until entering a vertical blanking period;

ending the swing boost mode to enter a swing recovery mode in the vertical blank period;

reducing the swing of the data signal from the high level to the normal level by the transmitter circuit in the swing recovery mode; and in a condition that the timing controller is operated in the swing recovery mode, ending the swing recovery mode and entering the normal mode when the lock signal fed back by the source driving circuit indicates that the data signal is locked.

14. The operation method according to claim 13, further comprising:

in the condition that the timing controller is operated in the swing recovery mode, ending the swing recovery mode and entering the swing boost mode when the lock signal fed back by the source driving circuit indicates that the quality of the data signal is deteriorated.

15. The operation method according to claim 9, further comprising:

in the condition that the timing controller is operated in the swing boost mode, keeping the timing controller operated in the swing boost mode when the lock signal fed back by the source driving circuit indicates that the data signal is locked until a noise preventing period ends;

ending the swing boost mode to enter a swing recovery mode when the noise preventing period ends;

reducing the swing of the data signal from the high level to the normal level by the transmitter circuit in the swing recovery mode; and in a condition that the timing controller is operated in the swing recovery mode, ending the swing recovery mode and entering the normal mode when the lock signal fed back by the source driving circuit indicates that the data signal is locked.

16. The operation method according to claim 9, further comprising:

in the condition that the timing controller is operated in the swing boost mode, keeping the timing controller operated in the swing boost mode when the lock signal fed back by the source driving circuit indicates that the data signal is locked until the timing controller is powered off.

* * * * *